US009335085B2

(12) United States Patent
Lingelbach et al.

(10) Patent No.: US 9,335,085 B2
(45) Date of Patent: May 10, 2016

(54) CONDENSER EVAPORATOR SYSTEM (CES) FOR DECENTRALIZED CONDENSER REFRIGERATION

(71) Applicants: Fred Lingelbach, Elkhorn, NE (US); John Lingelbach, Elkhorn, NE (US)

(72) Inventors: Fred Lingelbach, Elkhorn, NE (US); John Lingelbach, Elkhorn, NE (US)

( * ) Notice: Subject to any disclaimer, the term of this patent is extended or adjusted under 35 U.S.C. 154(b) by 0 days.

(21) Appl. No.: 14/036,407

(22) Filed: Sep. 25, 2013

(65) Prior Publication Data

US 2014/0157801 A1 Jun. 12, 2014

Related U.S. Application Data

(63) Continuation of application No. 13/495,427, filed on Jun. 13, 2012, now Pat. No. 8,544,283.

(60) Provisional application No. 61/496,156, filed on Jun. 13, 2011.

(51) Int. Cl.

| | |
|---|---|
| ***F25B 41/00*** | (2006.01) |
| ***F25D 21/06*** | (2006.01) |
| ***F25B 47/02*** | (2006.01) |

(Continued)

(52) U.S. Cl.

CPC ..... *F25D 21/06* (2013.01); *F25B 47/025* (2013.01); *F25B 1/10* (2013.01); *F25B 5/02* (2013.01); *F25B 6/02* (2013.01); *F25B 25/005* (2013.01); *F25B 41/043* (2013.01); *F25B 43/006* (2013.01); *F25B 2339/047* (2013.01); *F25B 2341/0662* (2013.01); *F25B 2400/072* (2013.01); *F25B 2400/161* (2013.01); *F25B 2600/05* (2013.01);

(Continued)

(58) Field of Classification Search

CPC ..... F25B 47/022; F25B 13/00; F25B 2600/2523; F25B 2600/05

USPC ..... 62/81, 92, 270, 277, 503, 509, 513, 515

See application file for complete search history.

(56) References Cited

U.S. PATENT DOCUMENTS

| | | | |
|---|---|---|---|
| 1,977,054 | A | 10/1934 | Giles |
| 2,003,310 | A | 6/1935 | Rexwinkle |

(Continued)

FOREIGN PATENT DOCUMENTS

| | | | |
|---|---|---|---|
| CN | 101476791 | A | 7/2009 |
| EP | 0 931 993 | A1 | 7/1999 |

(Continued)

OTHER PUBLICATIONS

International Preliminary Report on Patentability for PCT Application No. PCT/US2012/042223 dated Dec. 17, 2013.

(Continued)

*Primary Examiner* — Melvin Jones

(74) *Attorney, Agent, or Firm* — Merchant & Gould, P.C.

(57) ABSTRACT

A condenser evaporator system includes: a condenser constructed for condensing a gaseous refrigerant from the source of compressed gaseous refrigerant; a controlled pressure receiver for holding liquid refrigerant; a first liquid refrigerant feed line for conveying liquid refrigerant from the condenser to the controlled pressure receiver; an evaporator for evaporating liquid refrigerant; and a second liquid refrigerant feed line for conveying liquid refrigerant from the controlled pressure receiver to the evaporator. The condenser evaporator system can be provided as multiple condenser evaporator systems operating from a source of compressed gaseous refrigerant.

18 Claims, 7 Drawing Sheets

(51) Int. Cl.

| | |
|---|---|
| *F25B 1/10* | (2006.01) |
| *F25B 5/02* | (2006.01) |
| *F25B 6/02* | (2006.01) |
| *F25B 25/00* | (2006.01) |
| *F25B 41/04* | (2006.01) |
| *F25B 43/00* | (2006.01) |

(52) U.S. Cl.
CPC ..... *F25B 2600/2523* (2013.01); *F25B 2700/04* (2013.01)

(56) References Cited

U.S. PATENT DOCUMENTS

| | | | | |
|---|---|---|---|---|
| 2,290,711 | A | | 7/1942 | Robinson et al. |
| 2,336,097 | A | | 12/1943 | Hutchinson |
| 2,487,001 | A | | 11/1949 | Taylor et al. |
| 2,530,681 | A | | 11/1950 | Clancy |
| 3,041,854 | A | | 7/1962 | Arganbright et al. |
| 3,300,993 | A | | 1/1967 | Schlemmer |
| 3,353,367 | A | | 11/1967 | Garland et al. |
| 3,919,859 | A | * | 11/1975 | Ross ..... 62/503 |
| 4,151,724 | A | | 5/1979 | Garland |
| 4,210,001 | A | | 7/1980 | Miller, Sr. |
| 4,315,404 | A | | 2/1982 | Schmitt et al. |
| 4,484,453 | A | | 11/1984 | Niess |
| 4,763,488 | A | | 8/1988 | Johnston |
| 5,189,885 | A | | 3/1993 | Ni |
| 5,413,728 | A | | 5/1995 | Mall et al. |
| 5,435,149 | A | | 7/1995 | Strong et al. |
| 5,546,757 | A | * | 8/1996 | Whipple, III ..... 62/225 |
| 5,626,025 | A | | 5/1997 | Hyde |
| 5,660,047 | A | | 8/1997 | Paganessi |
| 5,671,607 | A | | 9/1997 | Clemens et al. |
| 6,018,956 | A | | 2/2000 | Sakata et al. |
| 6,018,958 | A | | 2/2000 | Lingelbach et al. |
| 6,070,426 | A | | 6/2000 | Sakashita et al. |
| 6,170,270 | B1 | | 1/2001 | Arshansky et al. |
| 6,349,564 | B1 | | 2/2002 | Lingelbach et al. |
| 6,467,301 | B1 | | 10/2002 | Lingelbach et al. |
| 6,467,302 | B1 | | 10/2002 | Lingelbach et al. |
| 7,082,774 | B2 | | 8/2006 | Ayub |
| 7,178,356 | B1 | | 2/2007 | Lingelbach et al. |
| 7,823,413 | B2 | | 11/2010 | Beving et al. |
| 2001/0023594 | A1 | | 9/2001 | Ives |
| 2006/0107671 | A1 | | 5/2006 | Yoshida et al. |
| 2007/0234753 | A1 | | 10/2007 | Nemoto et al. |
| 2008/0060365 | A1 | | 3/2008 | Sakitani et al. |
| 2008/0184724 | A1 | | 8/2008 | Jagusztyn |
| 2008/0223074 | A1 | | 9/2008 | Pachai et al. |
| 2009/0165482 | A1 | | 7/2009 | Ko et al. |
| 2009/0282849 | A1 | | 11/2009 | Fujimoto et al. |
| 2009/0301112 | A1 | | 12/2009 | Nelson |
| 2010/0037645 | A1 | | 2/2010 | Cieslik et al. |
| 2012/0312033 | A1 | | 12/2012 | Lingelbach et al. |
| 2012/0312038 | A1 | | 12/2012 | Lingelbach et al. |

FOREIGN PATENT DOCUMENTS

| | | | |
|---|---|---|---|
| EP | 1 134 514 | A1 | 9/2001 |
| EP | 1 795 836 | A1 | 6/2007 |
| EP | 2 068 094 | A1 | 6/2009 |
| EP | 2 077 427 | A1 | 7/2009 |
| GB | 2 245 494 | A | 4/1992 |
| WO | WO 95/30117 | A1 | 11/1995 |
| WO | WO 2008/112554 | A1 | 9/2008 |
| WO | WO 2008/112566 | A2 | 9/2008 |
| WO | WO 2008/112572 | A1 | 9/2008 |
| WO | WO 2008/112591 | A2 | 9/2008 |
| WO | WO 2009/109036 | A1 | 9/2009 |
| WO | WO 2011/049778 | A1 | 4/2011 |
| WO | WO 2012/174093 | A1 | 12/2012 |

OTHER PUBLICATIONS

Invitation to Pay Additional Fees and Partial International Search Report dated Feb. 13, 2013 for PCT/US2012/042223.
The Notification of the First Office Action from the Chinese Patent Office issued Aug. 19, 2015.
Australian Patent Examination Report No. 1 dated Feb. 12, 2015.
Pending claims of U.S. Appl. No. 13/495,468 as of Oct. 2015.

* cited by examiner

CONDENSER EVAPORATOR SYSTEM (CES) FOR DECENTRALIZED CONDENSER REFRIGERATION

CROSS REFERENCE TO RELATED APPLICATIONS

This application is a continuation of application Ser. No. 13/495,427 that was filed on Jun. 13, 2012 and which granted as U.S. Pat. No. 8,544,283. Application Ser. No. 13/495,427 includes the disclosure of U.S. provisional application Ser. No. 61/496,156 that was filed with the United States Patent and Trademark Office on Jun. 13, 2011. A priority right is claimed to U.S. provisional application Ser. No. 61/496,156 to the extent appropriate. The complete disclosures of application Ser. Nos. 13/495,427 and 61/496,156 are incorporated herein by reference.

FIELD OF THE INVENTION

The disclosure generally relates to a condenser evaporator system (CES) for a refrigeration system, and the operation of the condenser evaporator system. The condenser evaporator system can be considered a subsystem of an overall refrigeration system. Gaseous refrigerant is delivered to the condenser evaporator system and gaseous refrigerant is recovered from the condenser evaporator system. Multiple condenser evaporator systems can be provided within a refrigeration system having a centralized compressor arrangement. By utilizing one or more condenser evaporator system(s), a reduction in the amount of refrigerant in the overall refrigeration system can be achieved relative to a conventional refrigeration system having an equivalent capacity utilizing a centralized "condenser farm." In particular, the condenser evaporator system is advantageous for substantially reducing the amount of ammonia refrigerant needed for operating an industrial refrigeration system.

BACKGROUND

Refrigeration utilizes the basic thermodynamic property of evaporation to remove heat from a process. When a refrigerant is evaporated in a heat exchanger, the medium that is in contact with the heat exchanger (i.e., air, water, glycol, food) transfers heat from itself through the heat exchanger wall and is absorbed by the refrigerant, resulting in the refrigerant changing from a liquid state to a gaseous state. Once the refrigerant is in a gaseous state, the heat must be rejected by compressing the gas to a high pressure state and then passing the gas through a condenser (a heat exchanger) where heat is removed from the gas by a cooling medium resulting in condensation of the gas to a liquid. The medium in the condenser that absorbs the heat is often water, air, or both water and air. The refrigerant in this liquid state is then ready to be used again as a refrigerant for absorbing heat.

In general, industrial refrigeration systems utilize large amounts of horsepower oftentimes requiring multiple industrial compressors. Due to this fact, industrial refrigeration systems typically include large centralized engine rooms and large centralized condensing systems. Once the compressors compress the gas, the gas that is to be condensed (not used for defrosting) is pumped to a condenser in the large centralized condensing system. The multiple condensers in a large centralized condensing system are often referred to as the "condenser farm." Once the refrigerant is condensed, the resulting liquid refrigerant is collected in a vessel called a receiver, which is basically a tank of liquid refrigerant.

There are generally three systems for conveying the liquid from the receiver to the evaporators so it can be used for cooling. They are the liquid overfeed system, the direct expansion system, and the pumper drum system. The most common type of system is the liquid overfeed system. The liquid overfeed system generally uses liquid pumps to pump liquid refrigerant from large vessels called "pump accumulators" and sometimes from similar vessels called "intercoolers" to each evaporator. A single pump or multiple pumps may deliver liquid refrigerant to a number of evaporators in a given refrigeration system. Because liquid refrigerant has a tendency to evaporate, it is often necessary to keep large amounts of liquid in the vessels (net positive suction head (NPSH)) so the pump does not lose its prime and cavitate. A pump cavitates when the liquid that the pump is attempting to pump absorbs heat inside and around the pump and gasifies. When this happens, the pump cannot pump liquid to the various evaporators which starve the evaporators of liquid, thus causing the temperature of the process to rise. It is important to note that liquid overfeed systems are designed to overfeed the evaporators. That is, the systems send excess liquid to each evaporator in order to ensure that the evaporator has liquid refrigerant throughout the entire circuit of the evaporator. By doing this, it is normal for large amounts of liquid refrigerant to return from the evaporator to the accumulator where the liquid refrigerant in turn is pumped out again. In general, the systems are typically set up for an overfeed ratio of about 4:1, which means that for every 4 gallons of liquid pumped out to an evaporator, 1 gallon evaporates and absorbs the heat necessary for refrigeration, and 3 gallons return un-evaporated. The systems require a very large amount of liquified refrigerant in order to provide the necessary overfeed. As a result, the systems require maintaining a large amount of liquid refrigerant to operate properly.

Referring to FIG. 1, a representative industrial, two-stage refrigeration system is depicted at reference number 10 and provides for liquid overfeed where the refrigerant is ammonia. The plumbing of various liquid overfeed refrigeration systems may vary, but the general principles are consistent. The general principles include the use of a centralized condenser or condenser farm 18, a high pressure receiver 26 for collecting condensed refrigerant, and the transfer of liquid refrigerant from the high pressure receiver 26 to various stages 12 and 14. The two-stage refrigeration system 10 includes a low stage system 12 and a high stage system 14. A compressor system 16 drives both the low stage system 12 and the high stage system 14, with the high stage system 14 sending compressed ammonia gas to the condenser 18. The compressor system 16 includes a first stage compressor 20, second stage compressor 22, and an intercooler 24. The intercooler 24 can also be referred to as a high stage accumulator. Condensed ammonia from the condenser 18 is fed to the high pressure receiver 26 via the condenser drain line 27 where the high pressure liquid ammonia is held at a pressure typically between about 100 psi and about 200 psi. With reference to the low stage system 12, the liquid ammonia is piped to the low stage accumulator 28 via the liquid lines 30 and 32. The liquid ammonia in the low stage accumulator 28 is pumped by the low stage pump 34, through the low stage liquid line 36 to the low stage evaporator 38. At the low stage evaporator 38, the liquid ammonia comes in contact with the heat of the process, thus evaporating approximately 25% to 33% (the percent evaporated can vary widely), leaving the remaining ammonia as a liquid. The gas/liquid mixture returns to the low stage accumulator 28 via the low stage suction line 40. The evaporated gas is drawn into the low stage compressor 20 via the low stage compressor suction line 42. As the gas is removed from the low stage system 12 via the low stage compressor 20 it is discharged to the intercooler 24 via line 44. It is necessary to replenish the ammonia that has been evaporated, so liquid ammonia is transferred from the receiver 26 to the intercooler 24 via liquid line 30, and then to the low stage accumulator 28 via liquid line 32.

The high stage system 14 functions in a manner similar to the low stage system 12. The liquid ammonia in the high stage accumulator or intercooler 24 is pumped by the high stage pump 50, through the high stage liquid line 52 to the high stage evaporator 54. At the evaporator 54, the liquid ammonia comes in contact with the heat of the process, thus evaporating approximately 25% to 33% (the percent evaporated can vary widely), leaving the remaining ammonia as a liquid. The gas/liquid mixture returns to the high stage accumulator or intercooler 24 via the high stage suction line 56. The evaporated gas is then drawn into the high stage compressor 22 via the high stage compressor suction line 58. As the gas is removed from the high stage system 14, it is necessary to replenish the ammonia that has been evaporated, so liquid ammonia is transferred from the high pressure receiver 26 to the intercooler 24 via the liquid line 30.

The system 10 can be piped differently but the basic concept is that there is a central condenser 18 which is fed by the compressor system 16, and condensed high pressure liquid ammonia is stored in a high pressure receiver 26 until it is needed, and then the liquid ammonia flows to the high stage accumulators or intercooler 24, and is pumped to the high stage evaporator 54. In addition, liquid ammonia at the intercooler pressure flows to the low stage accumulator 28, via liquid line 32, where it is held until pumped to the low stage evaporator 38. The gas from the low stage compressor 20 is typically piped via the low stage compressor discharge line 44 to the intercooler 24, where the gas is cooled. The high stage compressor 22 draws gas from the intercooler 24, compresses the gas to a condensing pressure and discharges the gas via the high stage discharge line 60 to the condenser 18 where the gas condenses back to a liquid. The liquid drains via the condenser drain line 27 to the high pressure receiver 26, where the cycle starts again.

The direct expansion system uses high pressure or reduced pressure liquid from a centralized tank. The liquid is motivated by a pressure difference between the centralized tank and the evaporator as the centralized tank is at a higher pressure then the evaporator. A special valve called an expansion valve is used to meter the flow of refrigerant into the evaporator. If it feeds too much, then un-evaporated liquid refrigerant is allowed to pass through to the compressor system. If it feeds too little, then the evaporator is not used to its maximum capacity, possibly resulting in insufficient cooling/freezing.

The pumper drum system works in a nearly identical fashion to the liquid overfeed system, with the main difference being that small pressurized tanks act as pumps. In general, liquid refrigerant is allowed to fill the pumper drum, where a higher pressure refrigerant gas is then injected on top of the pumper drum thus using pressure differential to push the liquid into the pipes going to the evaporators. The overfeed ratios are generally the same, as is the large amount of refrigerant necessary to utilize this type of system.

SUMMARY

A plurality of condenser evaporator systems operating from a source of compressed gaseous refrigerant are provided by the present invention. Each condenser evaporator system includes: a condenser constructed for condensing a gaseous refrigerant from the source of compressed gaseous refrigerant; a controlled pressure receiver for holding liquid refrigerant; a first liquid refrigerant feed line for conveying liquid refrigerant from the condenser to the controlled pressure receiver; an evaporator for evaporating liquid refrigerant; and a second liquid refrigerant feed line for conveying liquid refrigerant from the controlled pressure receiver to the evaporator.

A condenser evaporator system is provided according to the present invention. The condenser evaporator system includes: a condenser constructed for condensing a gaseous refrigerant provided at a condensing pressure; a gaseous refrigerant feed line for feeding gaseous refrigerant to the condenser; a controlled pressure receiver for holding liquid refrigerant; a first liquid refrigerant feed line for conveying liquid refrigerant from the condenser to the controlled pressure receiver; an evaporator for evaporating liquid refrigerant; and a second liquid refrigerant feed line for conveying liquid refrigerant from the controlled pressure receiver to the evaporator. The condenser evaporator system can be constructed so that it is capable of using ammonia as the refrigerant. The condenser evaporator system can be constructed so that the condenser and the evaporator are balanced. The condenser evaporator system can be constructed so that the condenser is a plate and frame heat exchanger.

A method of operating a condenser evaporator system is provided by the present invention. The method includes: (a) operating the condenser evaporator system in a refrigeration cycle comprising: (i) feeding gaseous refrigerant at a condensing pressure to a condenser and condensing the gaseous refrigerant to liquid refrigerant; (ii) storing the liquid refrigerant in a controlled pressure receiver; (iii) feeding the liquid refrigerant from the controlled pressure receiver to an evaporator where it evaporates remaining heat from the process; and (b) operating the condenser evaporator system in a defrost cycle comprising: (i) feeding gaseous refrigerant at a condensing pressure to the evaporator and condensing the gaseous refrigerant to a liquid refrigerant; (ii) storing the liquid refrigerant in the controlled pressure receiver; and (iii) feeding the liquid refrigerant from the controlled pressure receiver to a condenser. The operation of the condenser evaporator system in a refrigeration cycle and the operation of the condenser evaporator system in a defrost cycle do not occur at the same time for a single condenser evaporator system.

DETAILED DESCRIPTION

Figure 1:
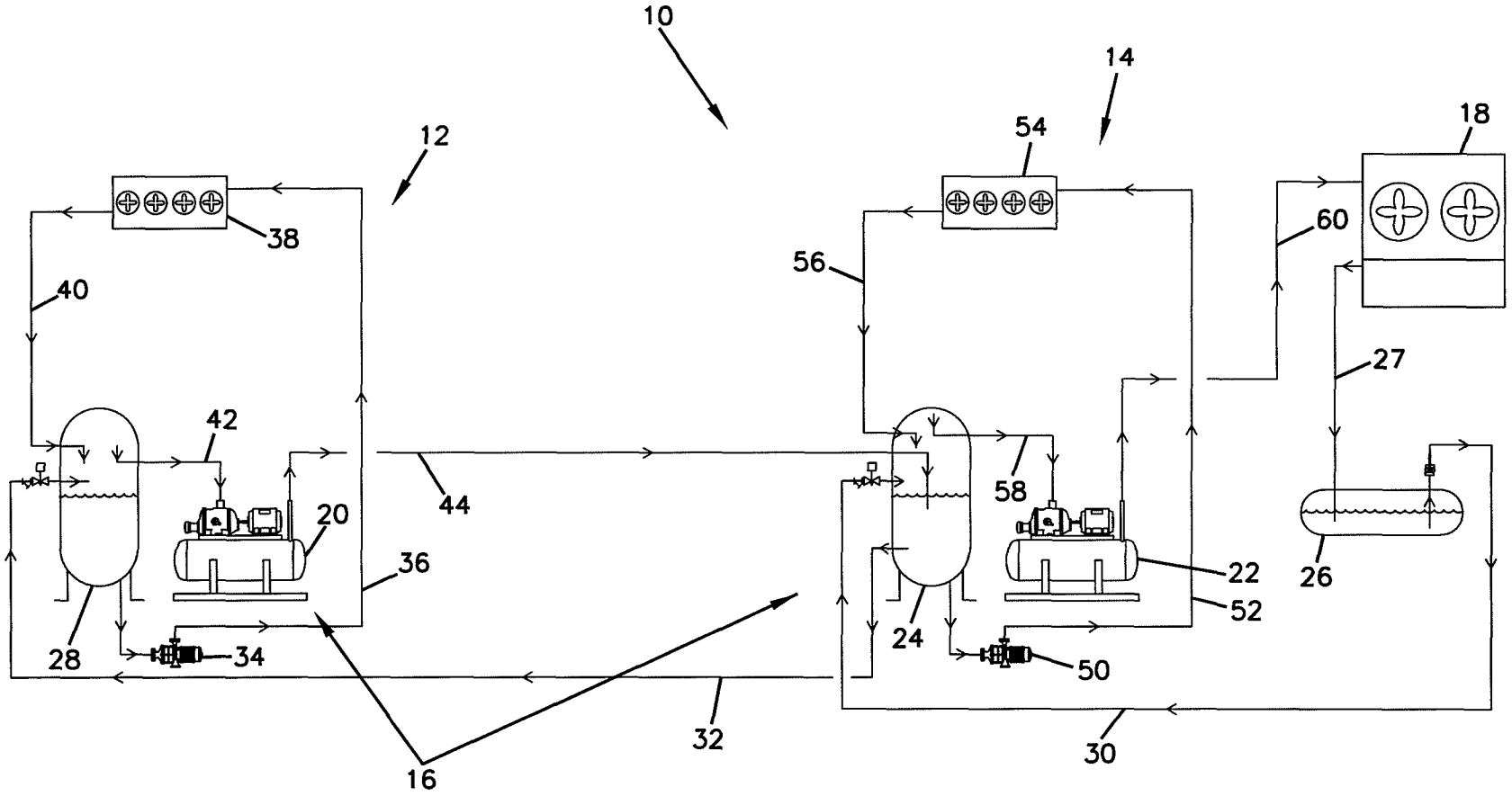
FIG. 1 is a schematic representation of a representative prior art industrial, multi-stage refrigeration system.

The condenser evaporator system (CES) can be considered a subsystem for a refrigeration system, and the refrigeration system can be one useful in an industrial environment. A single CES or multiple CESs can be used in an industrial refrigeration system. The refrigeration system in which the CES can be used can typically have a centralized compressor arrangement. The CESs can be characterized as decentralized when there are multiple CESs based on a centralized compressor arrangement so that gaseous refrigerant from the centralized compressor arrangement feeds the multiple CESs. As a result of transferring gaseous refrigerant from the centralized compressor arrangement to and from the one or more CESs, less refrigerant is needed to achieve a refrigeration capacity equivalent to the refrigeration capacity of other types of refrigeration systems where the refrigerant is condensed utilizing a centralized condenser arrangement that transfers liquid refrigerant to multiple evaporators according to the refrigeration system described in FIG. 1. Traditional ammonia refrigeration systems typically use a centralized condensing system and centralized storage tanks or vessels that hold large amounts of liquid ammonia in a controlled pressure receiver (CPR). Depending on the type of vessel and system, liquid pumps can be used to pump large quantities of liquid ammonia through the system to deliver liquid ammonia to the evaporators where heat transfers to the liquid ammonia refrigerant.

A refrigeration system that can utilize one or more CES is described in U.S. provisional patent application Ser. No. 61/496,160 filed with the United States Patent and Trademark Office on Jun. 13, 2011, the entire disclosure of which is incorporated herein by reference. Such a refrigeration system can be provided as a single stage system, a two stage system, or as a multiple stage system. In general, a single stage system is one where a single compressor compresses the refrigerant from an evaporative pressure to a condensing pressure. For example, in the case of ammonia refrigerant, the evaporative pressure can be about 30 psi and the condensing pressure can be about 150 psi. A multiple stage system, such as a two stage system, uses two or more compressors in series that pump from a low pressure (evaporative pressure) to an intermediate pressure, and then compresses the gas to a condensing pressure. An example of this would be a first compressor that compresses the gas from an evaporative pressure of about 0 psi to an intermediate pressure of about 30 psi, and a second compressor that compresses the gas from the intermediate pressure to a condensing pressure of about 150 psi. Some systems can include a single stage system operating from about −40° F. to about 150 psi and using, for example, a compressor that can operate with a large compression ratio such as a screw compressor. The purpose of a two stage system is primarily horsepower savings in addition to compressor compression ratio limitations on some models. Some plants may have two or more low stages, where one stage might be dedicated to run freezers at, for example, −10° F., and another stage might be dedicated to run blast freezers, for example, at −40° F. Some plants may have two or more high stages, or any combination of low and high stages. The CES can accommodate single, double, or any number or arrangements of stages.

The CES can be considered a subsystem to an overall refrigeration system, and includes a heat exchanger that acts as a condenser during refrigeration (and can optionally act as an evaporator during a defrost cycle), a controlled pressure receiver (CPR) that acts as a liquid refrigerant reservoir, an evaporator that absorbs the heat from the process (and can optionally act as a condenser during a defrost cycle), with the appropriate arrangement of valves. Because the CES can include a condenser, a liquid refrigerant reservoir, and an evaporator in a single assembly, the components can be sized to accommodate the heat load accordingly. Furthermore, the refrigeration system that utilizes one or more CES can be characterized as "decentralized" because of the absence of a centralized condenser and a centralized receiver for storing condensed liquid refrigerant that can be fed to evaporators. As a consequence, the movement of liquid refrigerant through the refrigeration system can be significantly decreased. By significantly reducing the amount of liquid refrigerant that is transported through the refrigeration system, the overall amount of liquid refrigerant in the refrigeration system can be significantly reduced. By way of example, for a prior art refrigeration system such as the one described in FIG. 1, the amount of refrigerant can be decreased by approximately 85% or more as a result of utilizing a refrigeration system according to the invention that provides for a centralized compressor arrangement and decentralized CESs while maintaining the same refrigeration capacity.

Figure 2:
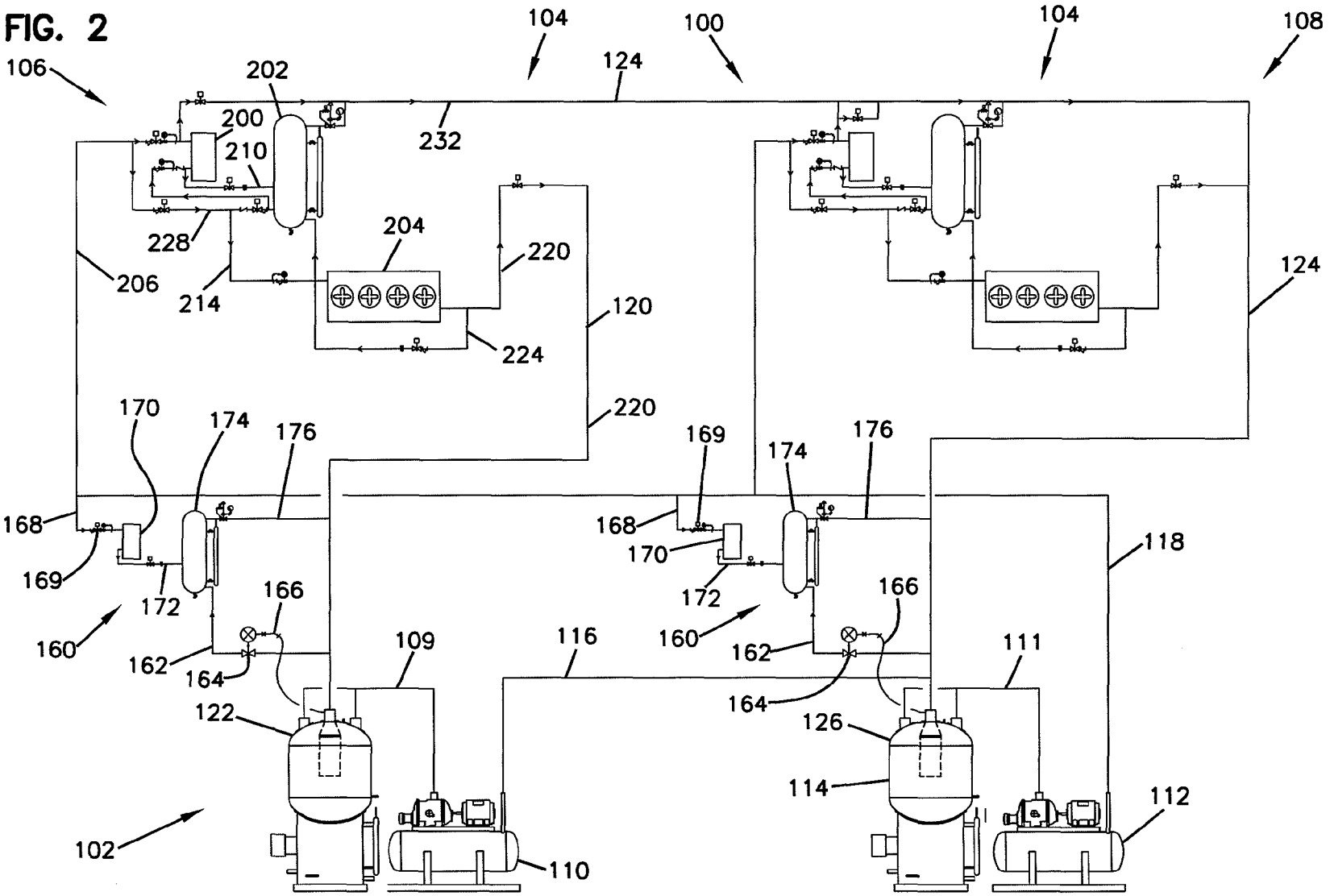
FIG. 2 is a schematic representation of a refrigeration system including multiple condenser evaporator systems according to the principles of the present invention.

Now referring to FIG. 2, a refrigeration system that utilizes multiple condenser evaporator systems (CES) according to the invention is shown at reference number 100. The refrigeration system 100 includes a centralized compressor arrangement 102 and a plurality of condenser evaporator systems 104. For the multi-stage refrigeration system 100, two condenser evaporator systems 106 and 108 are shown. It should be appreciated that additional condenser evaporator systems can be provided, as desired. The condenser evaporator system 106 can be referred to as a low stage condenser evaporator system, and the condenser evaporator system 108 can be referred to as a high stage condenser evaporator system. In general, the low stage CES 106 and high stage CES 108 are presented to illustrate how the multi-stage refrigeration system 100 can provide for different heat removal or cooling requirements. For example, the low stage CES 106 can be provided so that it operates to create a lower temperature environment than the environment created by the high stage CES 108. For example, the low stage CES 106 can be used to provide blast freezing at about −40° F. The high stage CES 108, for example, can provide an area that is cooled to a temperature significantly higher than −40° F. such as, for example, about ±10° F. to about 30° F. It should be understood that these values are provided for illustration. One would understand that the cooling requirements for any industrial facility can be selected and provided by the multi-stage refrigeration system according to the invention.

For the multi-stage refrigeration system 100, the centralized compressor arrangement 102 includes a first stage compressor arrangement 110 and a second stage compressor arrangement 112. The first stage compressor arrangement 110 can be referred to as a first or low stage compressor, and the second stage compressor arrangement 112 can be referred to as a second or high stage compressor. Provided between the first stage compressor arrangement 110 and the second stage compressor arrangement 112 is an intercooler 114. In general, gaseous refrigerant is fed via the first stage compressor inlet line 109 to the first stage compressor arrangement 110 where it is compressed to an intermediate pressure, and the gaseous refrigerant at the intermediate pressure is conveyed via the intermediate pressure refrigerant gas line 116 to the intercooler 114. The intercooler 114 allows the gaseous refrigerant at the intermediate pressure to cool, but also allows any liquid refrigerant to be separated from the gaseous refrigerant. The intermediate pressure refrigerant is then fed to the second stage compressor arrangement 112 via the second stage compressor inlet line 111 where the refrigerant is compressed to a condensing pressure. By way of example, and in the case of ammonia as the refrigerant, gaseous refrigerant may enter the first stage compressor arrangement 110 at a pressure of about 0 psi, and can be compressed to a pressure of about 30 psi. The gaseous refrigerant at about 30 psi can then be compressed via the second stage compressor arrangement 112 to a pressure of about 150 psi.

In general operation, the gaseous refrigerant compressed by the centralized compressor arrangement 102 flows via the hot gas line 118 to the plurality of condenser evaporator systems 104. The gaseous refrigerant from the compressor arrangement 102 that flows into the hot gas line 118 can be referred to as a source of compressed gaseous refrigerant that is used to feed one or more compressor evaporator systems 104. As shown in FIG. 2, the source of compressed gaseous refrigerant feeds both the CES 106 and the CES 108. The source of compressed gaseous refrigerant can be used to feed more than two compressor evaporator systems. For an industrial ammonia refrigeration system, the single source of compressed gaseous refrigerant can be used to feed any number of compressor evaporator systems, such as, for example, at least one, at least two, at least three, at least four, etc. compressor evaporator systems.

The gaseous refrigerant from the low stage CES 106 is recovered via the low stage suction (LSS) line 120 and is fed to the accumulator 122. The gaseous refrigerant from the high stage CES 108 is recovered via the high stage suction line (HSS) 124 and is fed to the accumulator 126. As discussed previously, the intercooler 114 can be characterized as the accumulator 126. The accumulators 122 and 126 can be constructed for receiving gaseous refrigerant and allowing separation between gaseous refrigerant and liquid refrigerant so that essentially only gaseous refrigerant is sent to the first stage compressor arrangement 110 and the second stage compressor arrangement 112.

Gaseous refrigerant returns to the accumulators 122 and 126 via the low stage suction line 120 and the high stage suction line 124, respectively. It is desirable to provide the returning gaseous refrigerant at a temperature that is not too hot or too cool. If the returning refrigerant is too hot the additional heat (i.e., superheat) may adversely effect the heat of compression in the compressor arrangements 110 and 112. If the returning refrigerant is too cool, there may be a tendency for too much liquid refrigerant to build up in the accumulators 122 and 126. Various techniques can be utilized for controlling the temperature of the returning gaseous refrigerant. One technique shown in FIG. 2 is a squelch system 160. The squelch system 160 operates by introducing liquid refrigerant into the returning gaseous refrigerant via the liquid refrigerant line 162. The liquid refrigerant introduced into the returning gaseous refrigerant in the low stage suction line 120 or the high stage suction line 124 can reduce the temperature of the returning gaseous refrigerant. A valve 164 can be provided for controlling flow of liquid refrigerant through the liquid refrigerant line 162, and can respond as a result of a signal 166 from the accumulators 122 and 126. Gaseous refrigerant can flow from the hot gas line 118 to the gaseous refrigerant squelch line 168 where flow is controlled by a valve 169. A heat exchanger 170 condenses the gaseous refrigerant, and the liquid refrigerant flows via the liquid refrigerant line 172 into a controlled pressure receiver 174. A controlled pressure receiver pressure line 176 can provide communication between the low stage suction line 120 or the high stage suction line 124 and the controlled pressure receiver 174 in order to enhance flow of liquid refrigerant through the liquid refrigerant line 162.

The accumulators 122 and 126 can be constructed so that they allow for the accumulation of liquid refrigerant therein. In general, the refrigerant returning from the low stage suction line 120 and the high stage suction line 124 is gaseous. Some gaseous refrigerant may condense and collect in the accumulators 122 and 126. The accumulators can be constructed so that they can provide evaporation of liquid refrigerant. In addition, the accumulators can be constructed so that a liquid refrigerant can be recovered therefrom. Under certain circumstances, the accumulators can be used to store liquid refrigerant.

Figure 3:
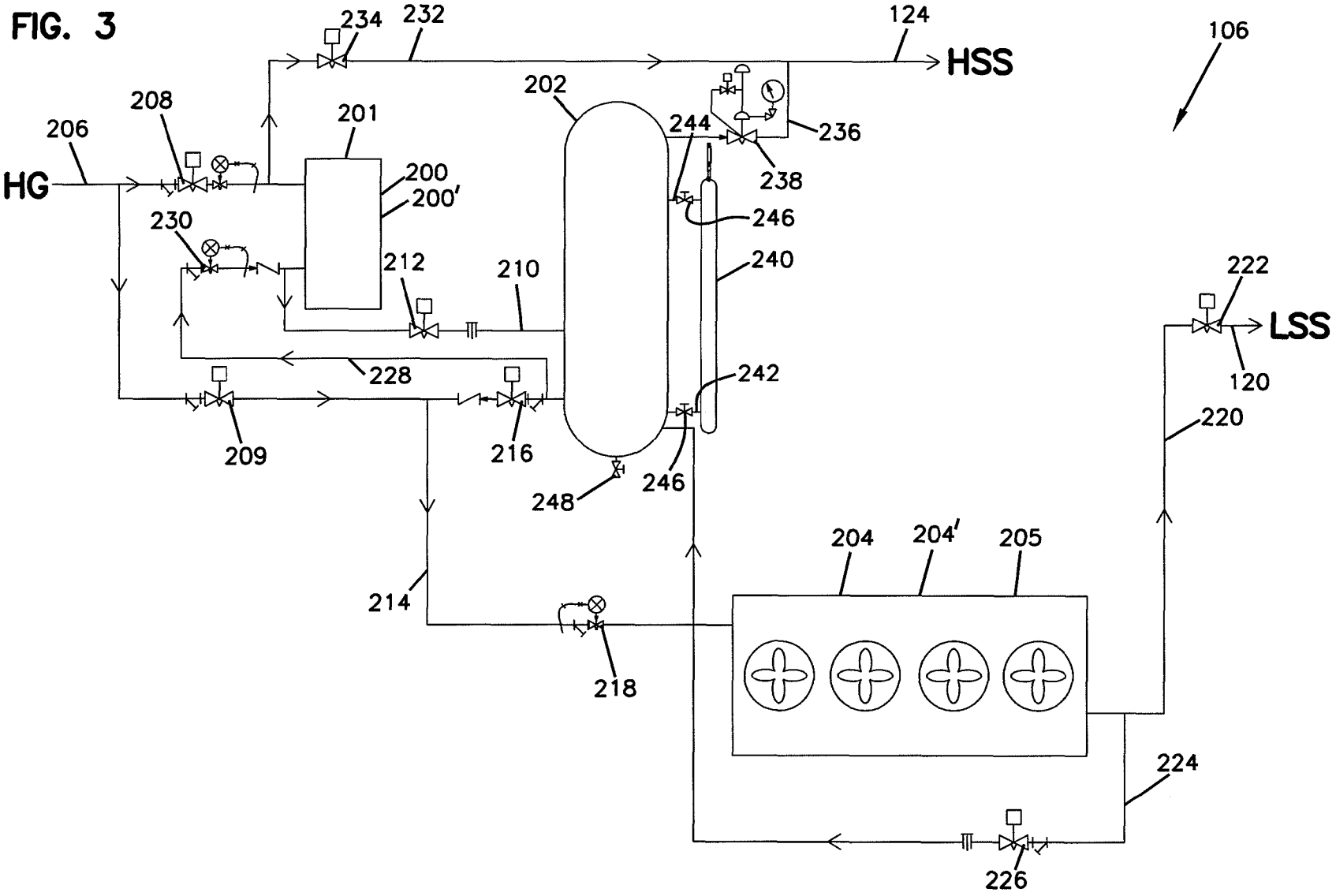
FIG. 3 is a schematic representation of a condenser evaporator system according to FIG. 2.

Now referring to FIG. 3, the condenser evaporator system 106 is provided in more detail. The condenser evaporator system 106 includes a condenser 200, a controlled pressure receiver 202, and an evaporator 204. In general, the condenser 200, the controlled pressure receiver 202, and the evaporator 204 can be sized so that they work together to provide the evaporator 204 with the desired refrigeration capacity. In general, the evaporator 204 is typically sized for the amount of heat it needs to absorb from a process. That is, the evaporator 204 is typically sized based upon the level of refrigeration it is supposed to provide in a given facility. The condenser 200 can be rated to condense the gaseous refrigerant at approximately the same rate that the evaporator 204 evaporates the refrigerant during refrigeration in order to provide a balanced flow within the CES. By providing a balanced flow, it is meant that the heat removed from the refrigerant by the condenser 200 is roughly equivalent to the heat absorbed by the refrigerant in the evaporator 204. It should be appreciated that a balanced flow can be considered a flow over a period of time that allows the evaporator to achieve a desired level of performance. In other words, as long as the evaporator 204 is performing as desired, the CES can be considered balanced. This is in contrast to a centralized condenser farm that services several evaporators. In the case of a centralized condenser farm servicing several evaporators, the condenser farm is not considered balanced with respected to any one particular evaporator. Instead, the condenser farm is considered balanced for the totality of the evaporators. In contrast, in the CES, the condenser 200 can be dedicated to the evaporator 204, and the condenser 200 can be referred to as an evaporator dedicated condenser. Within a CES, the condenser 200 can be provided as a single unit or as multiple units arranged in series or parallel. Similarly, the evaporator 204 can be provided as a single unit or multiple units arranged in series or parallel.

There may be occasions when the CES needs to be able to evaporate liquid refrigerant in the condenser 200. One reason is the use of hot gas defrosting in the CES. As a result, the condenser 200 can be sized so that it evaporates refrigerant at approximately the same rate that the evaporator 204 is condensing the refrigerant during the hot gas defrost in order to provide a balanced flow. As a result, the condenser 200 can be "larger" than required for condensing gaseous refrigerant during a refrigeration cycle.

For a conventional industrial refrigeration system that utilizes a centralized "condenser farm" and a plurality of evaporators that are fed liquid refrigerant from a central high pressure receiver, the condenser farm is not balanced with respect to any one of the evaporators. Instead, the condenser farm is generally balanced with the total thermal capacity of all of the evaporators. In contrast, for a CES, the condenser and the evaporator can be balanced with respect to each other.

The condenser evaporator system 106 can be considered a subsystem of an overall refrigeration system. As a subsystem, the condenser evaporator system can generally operate independently from other condenser evaporator systems that might also be present in the refrigeration system. Alternatively, the condenser evaporator system 106 can be provided so that it operates in conjunction with one or more other condenser evaporator systems in the refrigeration system. For example, two or more CESs can be provided that work together to refrigerate a particular environment.

The condenser evaporator system 106 can be provided so that it functions in both a refrigeration cycle and in a defrost cycle. The condenser 200 can be a heat exchanger 201 that functions as a condenser 200 in a refrigeration cycle and as an evaporator 200' in a hot gas defrost cycle. Similarly, the evaporator 204 can be a heat exchanger 205 that functions as an evaporator 204 in a refrigeration cycle and as a condenser 204' in a hot gas defrost cycle. Accordingly, one skilled in the art will understand that the heat exchanger 201 can be referred to as a condenser 200 when functioning in a refrigeration cycle and as an evaporator 200' when functioning in a hot gas defrost cycle. Similarly, the heat exchanger 205 can be referred to as an evaporator 204 when functioning in a refrigeration cycle and as a condenser 204' when functioning in a hot gas defrost cycle. A hot gas defrost cycle refers to a method where the gas from the compressor is introduced into an evaporator in order to heat the evaporator to melt any accumulated frost or ice. As a result, the hot gas loses heat and is condensed. The CES can be referred to as a dual function system when it can function in both refrigeration and hot gas defrost. A dual function system is beneficial for the overall condensing system because the condensing medium can be cooled during the hot gas defrost cycle, thus resulting in energy savings which increases overall efficiency. The frequency of a hot gas defrost cycle can vary from one defrost per day to defrosting every hour, and the savings by reclaiming this heat can be substantial. This type of heat reclamation is not possible in traditional systems that do not provide for a hot gas defrost cycle. Other methods for defrosting include, but are not limited to, using air, water, and electric heat. The condenser evaporator systems are adaptable to the various methods of defrosting.

The condenser evaporator system 106 can be fed gaseous refrigerant via the hot gas line 206. The condenser evaporator system 106 is provided at a location remote from the centralized compressor arrangement of the refrigeration system. By feeding gaseous refrigerant to the condenser evaporator system 106, there can be a significant reduction in the amount of refrigerant required by the refrigeration system because refrigerant being fed to the condenser evaporator systems 106 can be fed in a gaseous form rather than in a liquid form. As a result, the refrigeration system can function at a capacity essentially equivalent to the capacity of a conventional liquid feed system but with significantly less refrigerant in the overall system.

The operation of the condenser evaporator system 106 can be described when operating in a refrigeration cycle and when operating in a defrost cycle. The gaseous refrigerant flows through the hot gas line 206, and the flow of the gaseous refrigerant can be controlled by the hot gas refrigeration cycle flow control valve 208 and the hot gas defrost flow control valve 209. When operating in a refrigeration cycle, the valve 208 is open and the valve 209 is closed. When operating in a defrost cycle, the valve 208 is closed and the valve 209 is open. The valves 208 and 209 can be provided as on/off solenoid valves or as modulating valves that control the rate of flow of the gaseous refrigerant. The flow of refrigerant can be controlled or adjusted based on the liquid refrigerant level in the controlled pressure receiver 202.

The condenser 200 is a heat exchanger 201 that functions as a condenser when the condenser evaporator system 106 is functioning in a refrigeration cycle, and can function as an evaporator when the condenser evaporator system 106 is functioning in a defrost cycle such as a hot gas method of defrosting. When functioning as a condenser during a refrigeration cycle, the condenser condenses high pressure refrigerant gas by removing heat from the refrigerant gas. The refrigerant gas can be provided at a condensing pressure which means that once heat is removed from the gas, the gas will condense to a liquid. During the defrost cycle, the heat exchanger acts as an evaporator by evaporating condensed refrigerant. It should be appreciated that the heat exchanger is depicted in FIG. 3 as a single unit. However, it should be understood that it is representative of multiple units that can be arranged in parallel or series to provide the desired heat exchange capacity. For example, if additional capacity during defrost is required due to excess condensate, an additional heat exchanger unit can be employed. The heat exchanger 201 can be provided as a "plate and frame" heat exchanger. However, alternative heat exchangers can be utilized including shell and tube heat exchangers. The condensing medium for driving the heat exchanger can be water or a water solution such as a water and glycol solution or brine, or any cooling medium including carbon dioxide, glycol, or other refrigerants. The condensing medium can be cooled using conventional techniques such as, for example, a cooling tower or a ground thermal exchange. In addition, heat in the condensing medium can be used in other parts of an industrial or commercial facility.

Condensed refrigerant flows from the heat exchanger 201 to the controlled pressure receiver 202 via the condensed refrigerant line 210. The condensed refrigerant line 210 can include a condenser drain flow control valve 212. The condenser drain flow control valve 212 can control the flow of condensed refrigerant from the heat exchanger 200 to the controlled pressure receiver 202 during the refrigeration cycle. During the defrost cycle, the condenser drain flow control valve 212 can be provided to stop the flow of refrigerant from the heat exchanger 201 to the controlled pressure receiver 202. An example of the condenser drain flow control valve 212 is a solenoid and a float which only allows liquid to pass through and shuts off if gas is present.

The controlled pressure receiver 202 can be referred to more simply as the CPR or as the receiver. In general, a controlled pressure receiver is a receiver that, during operation, maintains a pressure within the receiver that is less than the condensing pressure. The lower pressure in the CPR can help drive flow, for example, from the condenser 200 to the CPR 202, and also from the CPR 202 to the evaporator 204. Furthermore, the evaporator 204 can operate more efficiently at a result of a pressure decrease by the presence of the CPR 202.

The controlled pressure receiver 202 acts as a reservoir for liquid refrigerant during both the refrigeration cycle and the defrost cycle. In general, the level of liquid refrigerant in the controlled pressure receiver 202 tends to be lower during the refrigeration cycle and higher during the defrost cycle. The reason for this is that the liquid refrigerant inside the evaporator 204 is removed during the defrost cycle and is placed in the controlled pressure receiver 202. Accordingly, the controlled pressure receiver 202 is sized so that it is large enough to hold the entire volume of liquid that is normally held in the evaporator 204 during the refrigeration cycle plus the volume of liquid held in the controlled pressure receiver 202 during the refrigeration cycle. Of course, the size of the controlled pressure receiver 202 can vary, if desired. As the level of refrigerant in the controlled pressure receiver 202 rises during a defrost cycle, the accumulated liquid can be evaporated in the evaporator 200'. In addition, the controlled pressure receiver can be provided as multiple units, if desired.

During the refrigeration cycle, liquid refrigerant flows from the controlled pressure receiver 202 to the evaporator 204 via the evaporator feed line 214. Liquid refrigerant flows out of the controlled pressure receiver 202 and through the control pressure liquid feed valve 216. The control pressure liquid feed valve 216 regulates the flow of liquid refrigerant from the controlled pressure receiver 202 to the evaporator 204. A feed valve 218 can be provided in the evaporator feed line 214 for providing more precise flow control. It should be understood, however, that if a precise flow valve such as an electronic expansion valve is used as the control pressure liquid feed valve 216, then the feed valve 218 may be unnecessary.

The evaporator 204 can be provided as an evaporator that removes heat from air, water, or any number of other mediums. Exemplary types of systems that can be cooled by the evaporator 204 include evaporator coils, shell and tube heat exchangers, plate and frame heat exchangers, contact plate freezers, spiral freezers, and freeze tunnels. The heat exchangers can cool or freeze storage freezers, processing floors, air, potable and non-potable fluids, and other chemicals. In nearly any application where heat is to be removed, practically any type of evaporator can be used with the CES system.

Gaseous refrigerant can be recovered from the evaporator 204 via the LSS line 220. Within the LSS line 220 can be provided a suction control valve 222. Optionally, an accumulator can be provided in line 220 to provide additional protection from liquid carryover. The suction control valve 222 controls the flow of evaporated refrigerant from the evaporator 204 to the centralized compressor arrangement. The suction control valve 222 is normally closed during the defrost cycle. In addition, during the defrost cycle, the evaporator 204 functions as a condenser condensing gaseous refrigerant to a liquid refrigerant, and the condensed liquid refrigerant flows from the evaporator 204 to the controlled pressure receiver 202 via the liquid refrigerant recovery line 224. Latent and sensible heat can be provided to defrost the evaporator during the defrost cycle. Other type of defrosting such as water and electric heat can be used to remove frost. Within the liquid refrigerant recovery line 224 can be a defrost condensate valve 226. The defrost condensate valve 226 controls the flow of condensed refrigerant from the evaporator 204 to the controlled pressure receiver 202 during the defrost cycle. The defrost condensate valve 226 is normally closed during the refrigeration cycle.

During the hot gas defrost cycle, liquid refrigerant from the controlled pressure receiver 202 may flow via the liquid refrigerant defrost line 228 to the evaporator 200' if controlled pressure receiver 202 gets too high. Within the liquid refrigerant defrost line 228 can be a defrost condensate evaporation feed valve 230. The defrost condensate evaporation feed valve 230 controls the flow of liquid refrigerant from the controlled pressure receiver 202 to the evaporator 200' during the defrost cycle to evaporate the liquid refrigerant into a gaseous state. During the defrost cycle, the evaporator 200' operates to cool the heat exchange medium flowing through the evaporator 200'. This can help to cool the medium which can help save electricity by allowing the cooling to lower the medium temperature for other condensers elsewhere in the plant where the refrigeration system is operating. Furthermore, during the hot gas defrost cycle, gaseous refrigerant flows out of the evaporator 200' via the HSS line 232. Within the HSS line is a defrost condensate evaporation pressure control valve 234. The defrost condensate evaporation pressure control valve 234 regulates the pressure within the evaporator 200' during the defrost cycle. The defrost condensate evaporation pressure control valve 234 is normally closed during the refrigeration cycle. The defrost condensate evaporation pressure control valve 234 can be piped to the LSS line 220. In general, this arrangement is not as efficient. It is also optional to include a small accumulator in line 232 to provide additional protection from liquid carryover.

Extending between the controlled pressure receiver 202 and the HSS line 232 is a controlled pressure receiver suction line 236. Within the controlled pressure receiver suction line 236 is a controlled pressure receiver pressure control valve 238. The controlled pressure receiver pressure control valve 238 controls the pressure within the controlled pressure receiver 202. It should be appreciated that the controlled pressure receiver suction line 236 can be arranged to that it extends from the controlled pressure receiver 202 to the LSS line 220 instead of or in addition to the HHS line 232. In general, it is more efficient for the controlled pressure receiver line to extend to the HSS line 232, or to the economizer port on a screw compressor, if available.

A controlled pressure receiver liquid level control assembly 240 is provided for monitoring the level of liquid refrigerant in the controlled pressure receiver 202. The information from the controlled pressure receiver liquid level control assembly 240 can be processed by a computer and various valves can be adjusted in order to maintain a desired level. The liquid refrigerant level within the controlled pressure receiver liquid level control assembly 240 can be observed, and the level changed as a result of communication via the liquid line 242 and the gaseous line 244. Both the liquid line 242 and the gaseous line 244 can include valves 246 for controlling flow.

At the bottom of the controlled pressure receiver 202 can be provided an optional oil drain valve 248. The oil drain valve 248 can be provided in order to remove any accumulated oil from the controlled pressure receiver 202. Oil often becomes entrained in refrigerant and tends to separate from liquid refrigerant and sinks to the bottom because it is heavier.

A compressor can be provided as a compressor dedicated for each CES. It is more preferable, however, for multiple CES's to feed a compressor or a centralized compressor arrangement. For an industrial system, a centralized compressor arrangement is typically more desirable.

One having ordinary skill in the art would understand that the various components of the condenser evaporator system 106 can be selected from generally accepted components as specified by ASME (American Society of Mechanical Engineers), ANSI (American National Standards Institute), AHSRAE (Association of Heating, Refrigeration, Air Conditioning Engineers), and IIAR (International Institute of Ammonia Refrigeration), and the valves, heat exchangers, vessels, controls, pipe, fittings, welding procedures, and other components should conform to those generally accepted standards.

The condenser evaporator system can provide for a reduction in the amount of refrigerant (such as, for example, ammonia) in an industrial refrigeration system. Industrial refrigeration systems include those that generally rely on centralized engine rooms where one or more compressors provide the compression for multiple evaporators, and a centralized condenser system. In such systems, liquid refrigerant is typically conveyed from a storage vessel to the multiple evaporators.

As a result, a large amount of liquid is often stored and transported to the various evaporators. By utilizing multiple condenser evaporator systems, it is possible that a reduction in the amount of refrigerant by approximately 85% can be achieved. It is expected that greater reductions can be achieved but that, of course, depends on the specific industrial refrigeration system. In order to understand how a reduction in the amount of ammonia in an industrial refrigeration system can be achieved, consider that during the refrigeration cycle, the refrigerant changes from a liquid to a gas by absorbing heat from a medium (such as, air, water, food, etc.). Liquid refrigerant (such as, ammonia) is delivered to an evaporator for evaporation. In many industrial refrigeration systems, the liquid refrigerant is held in centralized tanks called receivers, accumulators, and intercoolers depending on their function in the system. This liquid ammonia is then directed in a variety of ways to each evaporator in the facility for refrigeration. This means that much of the pipe in these industrial systems contain liquid ammonia. Just as a glass of water contains more water molecules then a glass that contains water vapor, liquid ammonia in a pipe contains typically 95% more ammonia in a given length of pipe versus a pipe with ammonia gas. The condenser evaporator system reduces the need for transporting large amounts of liquid refrigerant throughout the system by decentralizing the condensing system using one or more condenser evaporator system. Each condenser evaporator system can contain a condenser that is generally sized to the corresponding evaporator load. For example, for a 10 ton (120,000 BTU) evaporator, the condenser can be sized to at least the equivalent of 10 tons. In prior industrial refrigeration system, in order to get the evaporated gas back to a liquid so it can be evaporated again, the gas is compressed by a compressor and sent to one or more centralized condensers or condenser farms where the heat is removed from the ammonia, thus causing the refrigerant ammonia to condense to a liquid. This liquid is then directed to the various evaporators throughout the refrigerant system.

In a system that uses the CES, the gas from the evaporators is compressed by the compressors and sent back to the CES as high pressure gas. This gas is then fed to the condenser 200. During a refrigeration cycle, the condenser 200 (such as a plate and frame heat exchanger) has a cooling medium flowing there through. The cooling medium can include water, glycol, carbon dioxide or any acceptable cooling medium. The high pressure ammonia gas transfers the heat that it absorbed during compression to the cooling medium, thus causing the ammonia to condense to a liquid. This liquid is then fed to the controlled pressure receiver 202 which is held at a lower pressure then the condenser 200 so that the liquid can drain easily. The pressure in the controlled pressure receiver is regulated by the valve 238 in the controlled pressure receiver line 236. The liquid level inside the controlled pressure receiver 202 is monitored by a liquid level central assembly 240. If the liquid level gets too high or too low during refrigeration, valve 208 will open, close, or modulate accordingly to maintain the proper level.

The controlled pressure receiver 202 acts as a reservoir that holds the liquid to be fed into the evaporator 204. Since the condenser 200 and the controlled pressure receiver 202 are sized for each evaporator 204, the refrigerant is condensed as needed. Because the refrigerant is condensed in proximity to the evaporator 204 as needed, there is less of a need to transport liquid refrigerant over long distances thus allowing for the dramatic reduction in overall ammonia charge (for example, approximately 85% compared with a traditional refrigeration system having approximately the same refrigeration capacity). As the evaporator 204 requires more ammonia, valves 216 and 218 open to feed the right amount of ammonia into the evaporator 204 so that the ammonia is evaporated before the ammonia leaves the evaporator 204 so that no liquid ammonia goes back to the compressor arrangement. The valve 222 will shut the flow of ammonia off when the unit is off and/or undergoing defrosting.

The operation of the condenser evaporator system 106 can be explained in terms of both the refrigeration cycle and the defrost cycle. When the condenser evaporator system 106 operates in a refrigeration cycle, gaseous refrigerant at a condensing pressure is fed via the hot gas line 206 from the compressor system to the condenser 200. In this case, the refrigeration cycle flow control valve 208 is open and the hot gas defrost flow control valve 209 is closed. Gaseous refrigerant enters the condenser 200 and is condensed to a liquid refrigerant. The condenser 200 can utilize any suitable cooling medium such as water, glycol solution, etc. which is pumped through the condenser 200. One would understand that the heat recovered from the cooling medium can be recovered and used elsewhere.

Condensed refrigerant flows from the condenser 200 to the controlled pressure receiver 202 via the condensed refrigerant line 210 and the condenser drain flow control valve 212. Condensed refrigerant accumulates within the controlled pressure receiver 202, and the level of liquid refrigerant can be determined by the controlled pressure receiver liquid level control assembly 240. Liquid refrigerant flows out of the controlled pressure receiver 202 via the evaporator feed line 214 and the control pressure liquid feed valve 216 and 218 and into the evaporator 204. The liquid refrigerant within the evaporator 204 is evaporated and gaseous refrigerant is recovered from the evaporator 204 via the LSS line 220 and the suction control valve 222.

It is interesting to note that during the refrigeration cycle, there is no need to operate the evaporator based on liquid overfeed. That is, all of the liquid that enters the evaporator 204 can be used to provide refrigeration as a result of evaporating to gaseous refrigerant. As a result, heat transfers from a medium through the evaporator and into the liquid refrigerant causing the liquid refrigerant to become gaseous refrigerant. The medium can essential be any type of medium that is typically cooled. Exemplary media include air, water, food, carbon dioxide, and/or another refrigerant.

One of the consequences of refrigeration is the buildup of frost and ice on the evaporator. Therefore, every coil that receives refrigerant at low temperatures sufficient to develop frost and ice should go through a defrost cycle to maintain a clean and efficient coil. There are generally four methods of removing frost and ice on a coil. These methods include water, electric, air, or hot gas (such as high pressure ammonia). The CES will work with all methods of defrosting. The CES is particularly adapted for defrosting using the hot gas defrosting technique.

During hot gas defrost, the flow of hot gaseous refrigerant through the CES can be reversed so that the evaporator is defrosted. The hot gas can be fed to the evaporator and condensed to liquid refrigerant. The resulting liquid refrigerant can be evaporated in the condenser. This step of evaporating can be referred to as "local evaporating" because it occurs within the CES. As a result, one can avoid sending liquid refrigerant to a centralized vessel such as an accumulator for storage. The CES thereby can provide hot gas defrost of evaporators without the necessity of storing large quantities of liquid refrigerant.

During hot gas defrost, high pressure ammonia gas that normally goes to the condenser is instead directed into an evaporator. This warm gas condenses into a liquid, thus warming up the evaporator causing the internal temperature of the evaporator to become warm enough that the ice on the outside of the coils melts off. Prior refrigeration systems often take this condensed liquid and flow it back through pipes to large tanks where it is used again for refrigeration. A refrigeration system that utilizes the CES, in contrast, can use the condensed refrigerant generated during hot gas defrost and evaporate it back into a gas to cool the condensing medium in order to eliminate excess liquid ammonia in the system.

During a defrost cycle, gaseous refrigerant at a condensing pressure is feed via the hot gas line 206 to the condenser 204'. The gaseous refrigerant flows through the hot gas defrost flow control valve 209 (the refrigeration cycle control valve 208 is closed) and into the evaporator feed line 214 and through the feed valve 218. The gaseous refrigerant within the condenser 204' is condensed to liquid refrigerant (which consequently melts the ice and frost) and is recovered via the liquid refrigerant recovery line 224 and the defrost condensate valve 226. During defrost, the suction control valve 222 can be closed. The liquid refrigerant then flows via the liquid refrigerant recovery line 224 and into the controlled pressure receiver 202. As an alternative, with the correct valves and controls provided, at least a portion of the liquid refrigerant can flow directly from line 224 to line 228, bypassing the CPR 202. Liquid refrigerant flows from the controlled pressure receiver 202 via the liquid refrigerant defrost line 228 and through the defrost condensate evaporation feed valve 230 and into the evaporator 200'. At this time, the control pressure liquid feed valve 216 and the condenser drain flow control valve 212 are closed, and the defrost condensate evaporation feed valve 230 is open and can be modulating. During the defrost cycle, the liquid refrigerant within the evaporator 200' evaporates to form gaseous refrigerant, and the gaseous refrigerant is recovered via the HSS line 232. Furthermore, the defrost condensate evaporation pressure control valve 234 is open and modulating and the refrigeration cycle flow control valve 208 is closed.

One would understand that during the hot gas defrost cycle, the media on the other side of the condenser 204' is heated, and the media on the other side of the evaporator 200' is cooled. The evaporation that occurs during the defrost cycle has an additional effect in that it helps to cool the medium (such as water or water and glycol) in the condensing system which saves electricity because it lowers the discharge pressure of the compressors and reduces the heat exchanger cooling medium temperature.

It should be appreciated that the CES could be utilized without the hot gas defrost cycle. The other types of defrost can be utilized with the CES including air defrost, water defrost, or electric defrost. With regard to the schematic representation shown in FIGS. 2 and 3, one having ordinary skill would understand how the system could be modified to eliminate hot gas defrost and utilizing in its place, air defrost, water defrost, or electric defrost.

Ammonia reduction is becoming critical as ammonia has been classified by the Occupational Safety and Health Administration (OSHA) as a "toxic, reactive, flammable, or explosive chemical whose release may result in toxic, fire or explosion hazards" (Source: OSHA). Being as ammonia comes under this statute, OSHA has established a threshold quantity of 10,000 pounds or more of ammonia on site as a requirement to establish a Process Safety Management (PSM) program. Although any reduction in a toxic, reactive, flammable or explosive chemical is always desirable, it must be noted that many industrial refrigeration systems can be designed for the same size and capacity yet can provide their system under the 10,000 pounds threshold and eliminate the requirement for a PSM program. PSM programs are generally expensive and time consuming.

The CES can be used with rooftop type refrigeration systems where each evaporator or a limited number of evaporators are piped locally to one condensing unit where a matched compressor and condenser are mounted. Rooftop units are autonomous from each other and do not have interconnected refrigeration lines.

It is noted that with slight modification, the CES can be modified to operate in a flooded or recirculation system. The piping in the flooded method would be different, but the basic local condensing operation of the CES would be the same. Recirculation systems would incorporate a small dedicated pump to the CES, however both the flooded and pump methods would not be ideal as they would increase the amount of ammonia in any given plant.

The condenser evaporator system 106 in FIG. 3 can be characterized as a direct expansion feed system because of the use of direct expansion for feeding refrigerant to the evaporator. Alternative systems are available for use in the condenser evaporator system for feeding refrigerant to the evaporator. For example, the condenser evaporator system can provide for pump feed, flooded feed, or pressurized feed.

Figure 4:
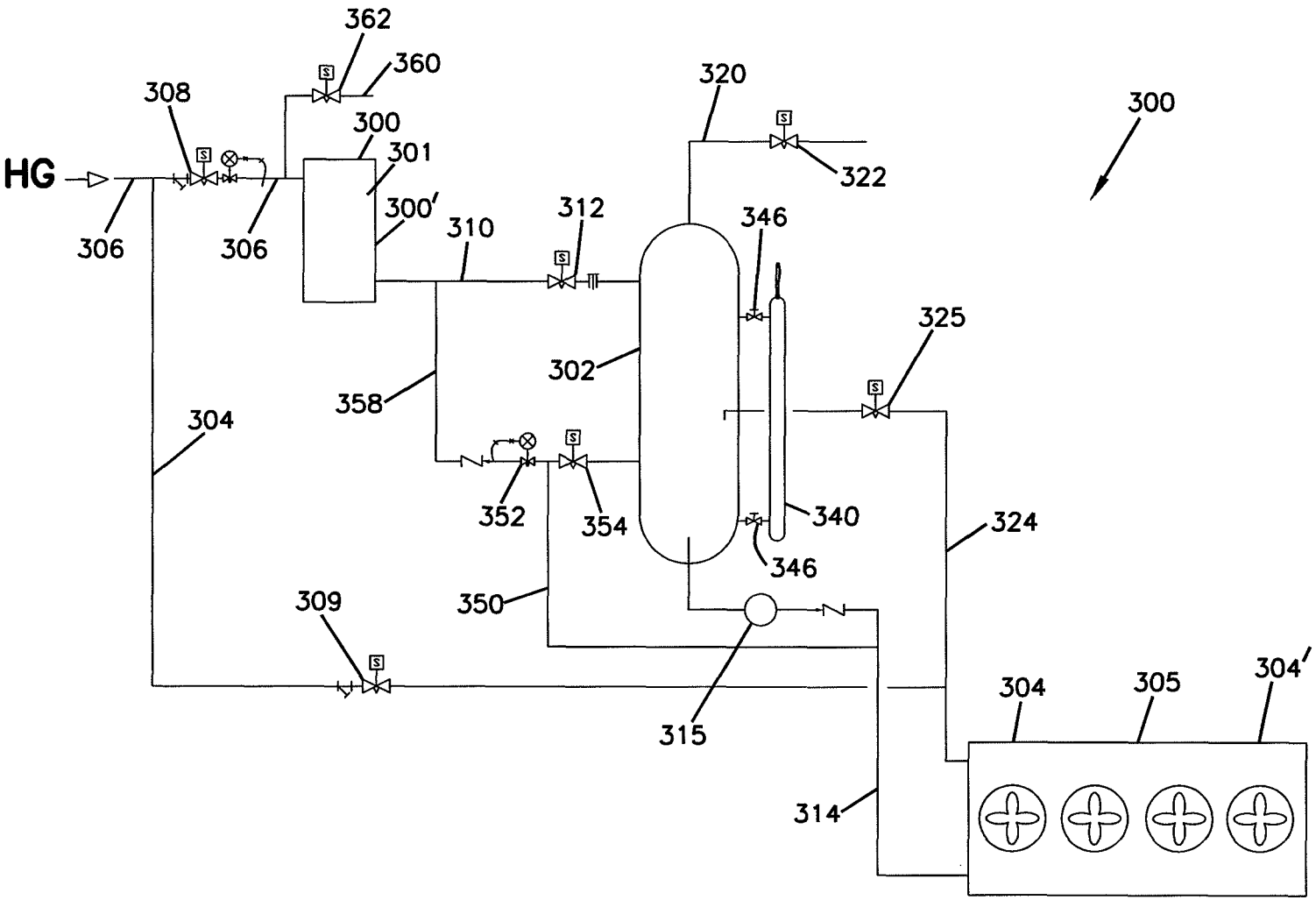
FIG. 4 is a schematic representation of an alternative condenser evaporator system according to the principles of the present invention.

Now referring to FIG. 4, an alternative condenser evaporator system is shown at reference number 300. The condenser evaporator system 300 can be referred to as a pump feed condenser evaporator system because it utilizes a pump 315 to feed liquid refrigerant to the evaporator 304. Hot gas at a condensing pressure is introduced via hot gas line 306 and may be regulated by the hot gas valve 308 for introduction into the condenser 300. The condenser 300 and the evaporator 304 are heat exchangers 301 and 305, respectively. During hot gas defrost, the heat exchanger 301 can be referred to as an evaporator 300', and the heat exchanger 305 can be referred to as a condenser 304'. Condensed, liquid refrigerant flows via liquid refrigerant line 310 from the condenser 300 to the controlled pressure receiver 302. Valve 312 can be provided in the liquid refrigerant line 310 to regulate flow into the controlled pressure receiver 302. The liquid refrigerant level in the controlled pressure receiver 302 can be monitored by the level monitor 340, and can be isolated by the valves 346. The liquid refrigerant in the controlled pressure receiver 302 can be fed via liquid refrigerant feed line 314 to the evaporator 304, and the flow can be controlled by the pump 315. Refrigerant from the evaporator 304 flows back to the controlled pressure receiver 302 via the evaporator return line 324, and flow may be controlled by the return valve 325. Inside controlled pressure receiver 302, gaseous and liquid refrigerant are separated. The gaseous refrigerant is drawn through the gaseous refrigerant recovery line 320 where it is recovered and compressed by the compressor system. Flow through the gaseous refrigerant recovery line 320 can be controlled by the gaseous refrigerant recovery valve 322.

During hot gas defrost, valves 308, 312, and 325 can be closed, and valve 322 can be closed or used to regulate flow. Hot gas can be introduced from the hot gas line 306 to the hot gas defrost line 304 and via the hot gas defrost valve 309 to the heat exchanger 305 or condenser 304'. Liquid refrigerant can flow from the heat exchanger 305 via the liquid refrigerant return line 350 to the controlled pressure receiver 302. Valves 352 and 354 can be used to control the flow of refrigerant from the refrigerant return line 350 to the controlled pressure receiver 302 or the heat exchanger 201. When the valve 354 is open, the refrigerant can flow into the controlled pressure receiver 302, which level is monitored by the level control 340, which can be isolated by valves 346. When the valve 352 is open, the refrigerant can flow via the heat exchanger feed line 358 and to the heat exchanger 301. The heat exchanger 301 can be used as an evaporator 300' to boil the liquid refrigerant to a gaseous refrigerant that can be returned to the compressor system via the gaseous refrigerant return line 360 and controlled by the return line valve 362. In the CES 300, it is possible for the refrigerant to bypass the controlled pressure receiver 302 during hot gas defrost. It should be noted that the CES 300 can work with other methods of defrosting, including electric, water, air, etc.

Figure 5:
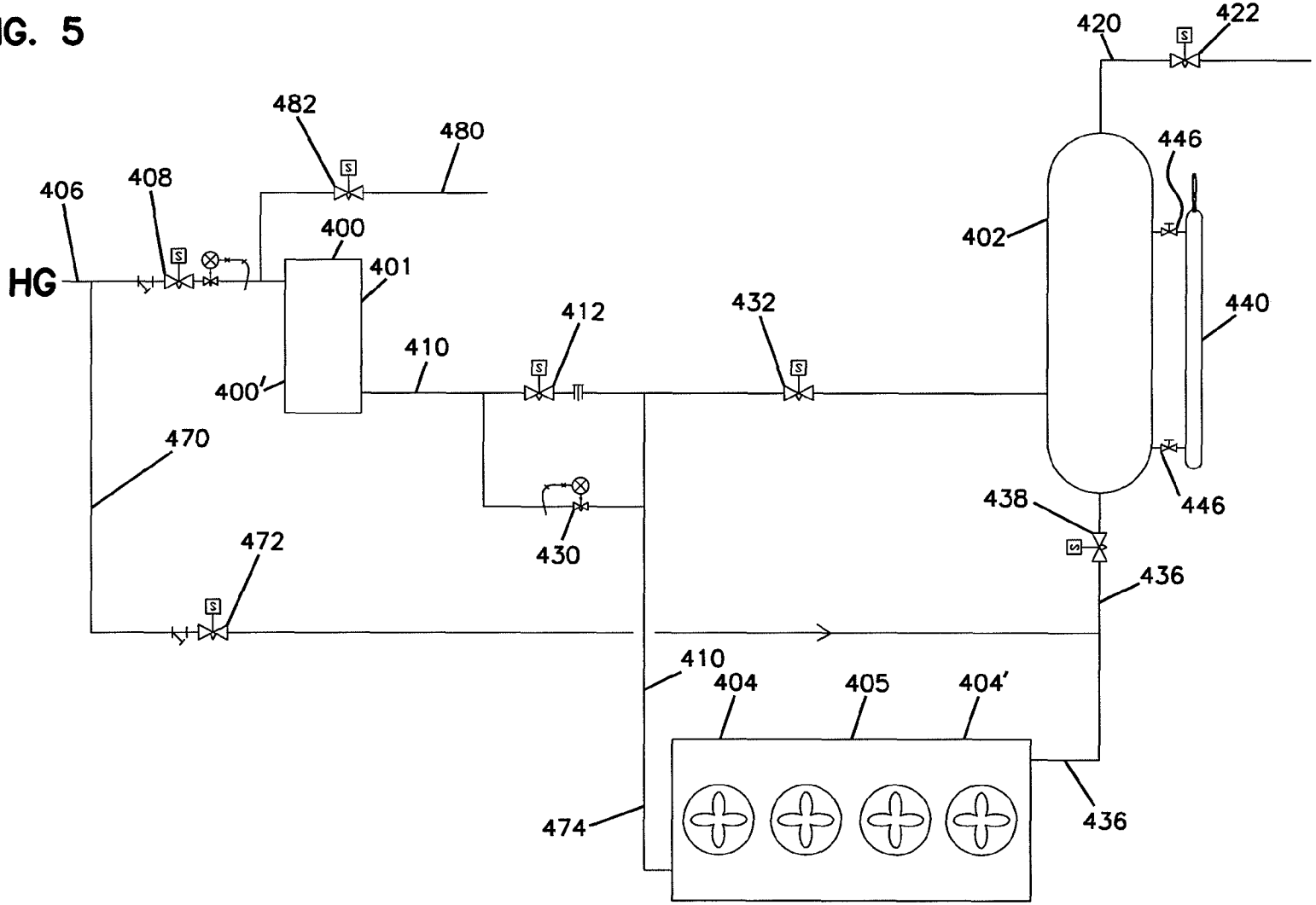
FIG. 5 is a schematic representation of an alternative condenser evaporator system according to the principles of the present invention.
Figure 6:
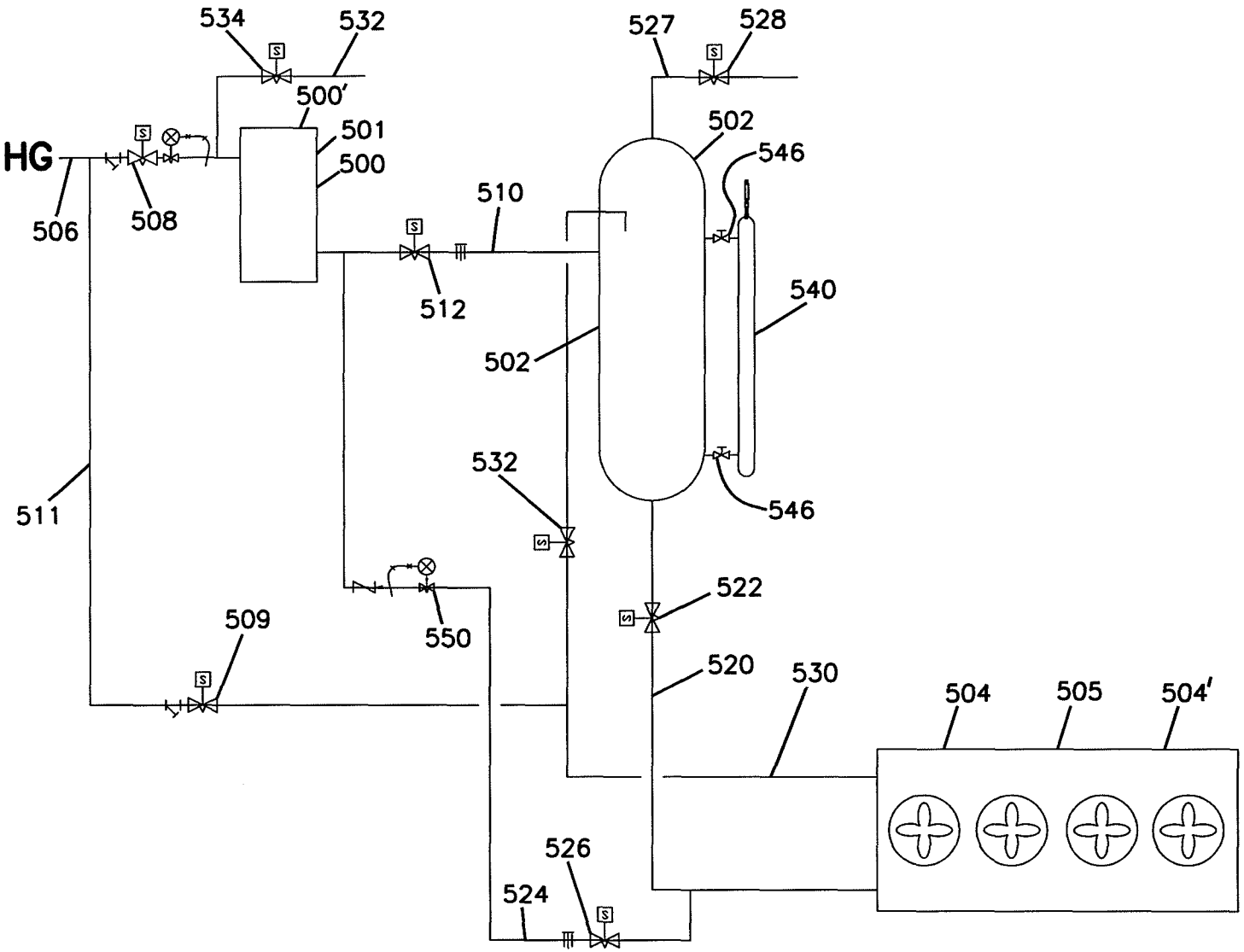
FIG. 6 is a schematic representation of an alternative condenser evaporator system according to the principles of the present invention.

Now referring to FIGS. 5 and 6, alternative flow condenser evaporator systems are shown that can be referred to as flooded feed systems.

FIG. 5 shows a feed with a controlled pressure receiver 402 on the suction side of the heat exchanger 405 (can be referred to as an evaporator 404 during a refrigeration cycle and as a condenser 404' during hot gas defrost). Hot gas refrigerant can be introduced via hot gas line 406 to the heat exchanger 401 (can be referred to as a condenser 400 during a refrigeration cycle and as an evaporator 400' during hot gas defrost), and flow can be regulated by the valve 408. As the refrigerant is condensed in the heat exchanger 401, condensed refrigerant can flow through the condensed refrigerant line 410 and valve 412 (which may contain a float) to the heat exchanger 405. It should be noted that valves 430 and 432 can be closed during the refrigeration cycle. As the liquid refrigerant floods the heat exchanger 405, refrigerant can be removed from the heat exchanger 405 via the controlled pressure receiver feed line 436, and flow to the controlled pressure receiver 402 can be controlled by the valve 438. The liquid and gaseous refrigerant can be separated inside the controlled pressure receiver 402. The liquid refrigerant level inside controlled pressure receiver 402 can be monitored by a level monitor 440, and can be isolated by valves 446. If the liquid level gets too high, valves 408 and/or 412 can reduce flow of refrigerant to the heat exchanger 405. Gaseous refrigerant can be drawn out of the controlled pressure receiver 402 via the line 420 (and flow can be controlled by the valve 422) and sent to the engine room where it can be compressed.

During hot gas defrost, the valves 438, 412, and 408 can be closed, and valve 422 can be closed or used to regulate flow. Hot gas is introduced to heat exchanger 405 via the hot gas line 406 and the hot gas feed line 470 and the hot gas feed valve 472. Liquid refrigerant that is condensed in the heat exchanger 405 can flow from the heat exchanger 405 via line 474. Valve 430 can control flow to the heat exchanger 401, and valve 432 can control flow to the controlled pressure receiver 402. During hot gas defrost, the heat exchanger 401 can be used as an evaporator to boil the liquid into a gas to be returned to the engine room via line 480 and valve 482. It should be understood that variation in the piping arrangement can be provided. Refrigerant can flow via line 474 and through valve 432 to the controlled pressure receiver 402. Liquid refrigerant can collect in the controlled pressure receiver 402. If desired, gaseous refrigerant can be recovered via line 420 and valve 422.

Now referring to FIG. 6, a condenser evaporator system is shown with a controlled pressure receiver 502 piped on both the suction and liquid side of the heat exchanger 505. During refrigeration, hot gas is introduced to the heat exchanger 501 via hot gas line 506 and regulated by the valve 508. The heat exchanger 501 can be referred to as a condenser 500 during a refrigeration cycle and as an evaporator 500' during a hot gas defrost cycle. As the refrigerant is condensed, it feeds through controlled pressure receiver feed line 510 and valve 512 (which may contain a float) to the controlled pressure receiver 502. Liquid in the controlled pressure receiver 502 is flooded to the heat exchanger 505 via flood line 520 and flood line valve 522. The heat exchanger 505 can be referred to as an evaporator 504 during a refrigeration cycle, and as a condenser 504' during a hot gas defrost cycle. The valve 526, in line 524, can be closed during refrigeration. A liquid and gas mixture can return to the controlled pressure receiver 502 via the refrigerant return line 530, and flow can be controlled by the valve 532. The liquid and gas can be separated in the controlled pressure receiver 502, and gas can be drawn through line 527 and valve 528 and sent to the engine room where it can be compressed.

The liquid level inside controlled pressure receiver 502 can be monitored by a level monitor 540, and can be isolated by valves 546. If the level gets too high, valves 508 and/or valve 512 can be closed or flow can be reduced to regulate a desired liquid level in the controlled pressure receiver 502. For low temperature (for example, −40° F.) applications, it may be desirable to have an additional controlled pressure receiver piped between heat exchanger 501 and the controlled pressure receiver 502 for providing greater capacity. This controlled pressure receiver could be piped to the higher suction pressure portion of the refrigeration system in order to remove a portion of the heat from the liquid refrigerant from the heat exchanger 501 prior to the liquid flowing to the controlled pressure receiver 502. This would facilitate an efficiency advantage.

During hot gas defrost, valves 532, 512, and 508 can be closed. Hot gas can be introduced to the heat exchanger 505 via hot gas line 511 and valve 509. From the heat exchanger 505, returning liquid and gaseous refrigerant can flow to the controlled pressure receiver 502 via valve line 520 and valve 522. Valve 522 will close if the level in controlled pressure receiver 502 gets too high. Alternatively, the liquid and gaseous refrigerant can flow via line 524 and valve 526 (which may contain a float) to the heat exchanger 501. The heat exchanger 501 can be used as an evaporator to boil the liquid back into a gas to be returned to the engine room via line 532 and valve 234. An optional feed valve 550 is shown that can regulate the returning refrigerant. Various piping variations are available.

Figure 7:
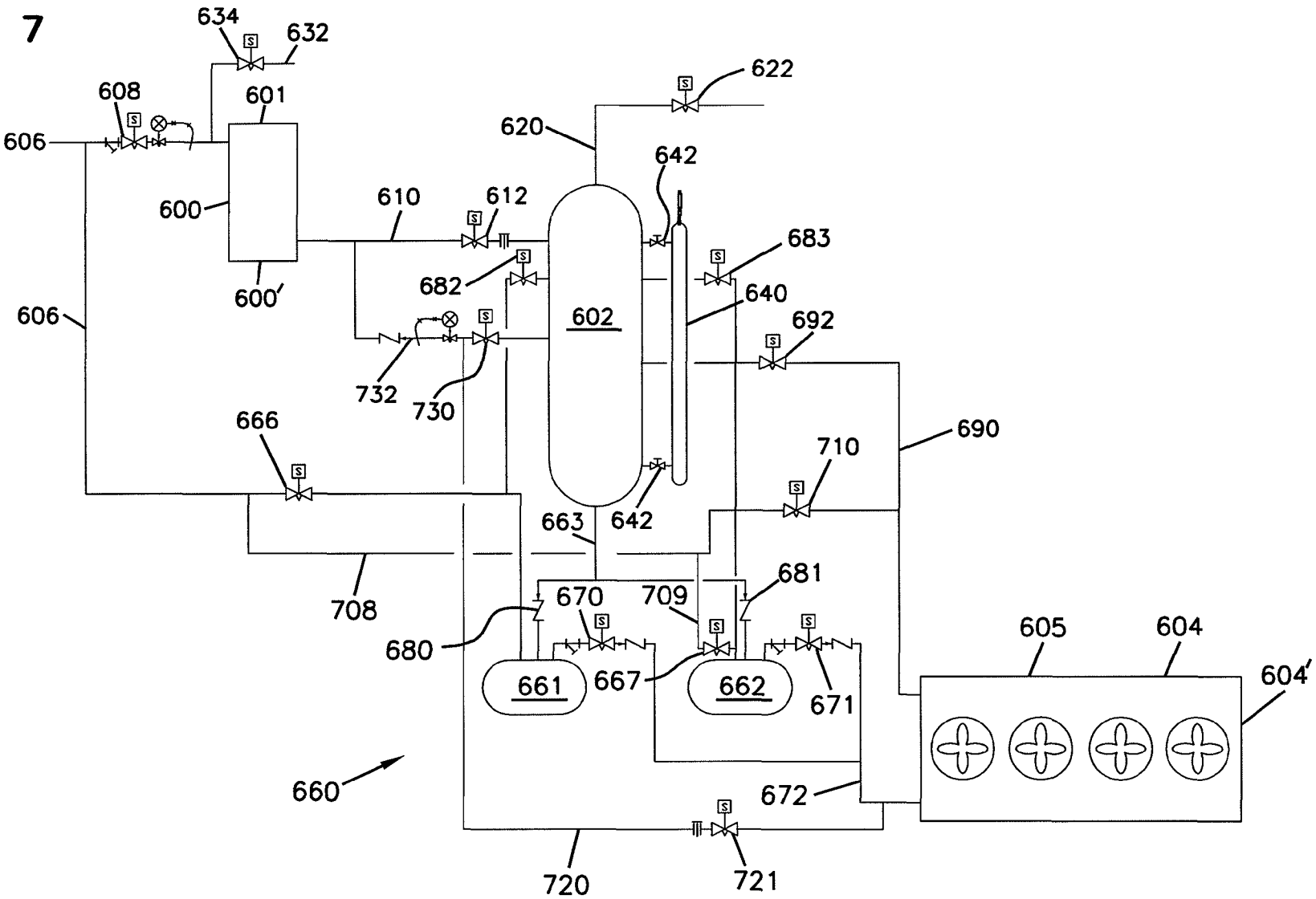
FIG. 7 is a schematic representation of an alternative condenser evaporator system according to the principles of the present invention.

Now referring to FIG. 7, an alternative compressor evaporator system is shown that can be characterized as a pressurized feed system. During a refrigeration cycle, hot gas is introduced to the heat exchanger 601 (the heat exchanger 601 can be referred to as a condenser 600 during a refrigeration cycle and as an evaporator 600' during hot gas defrost) via line 606, and regulated through the valve 608. As the refrigerant is condensed, the liquid refrigerant feeds through line 610 and valve 612 (which may include a float) to feed the refrigerant into the controlled pressure receiver 602. The level in controlled pressure receiver 602 can be monitored by a level monitor 640, and can be isolated by valves 646.

The liquid refrigerant can move from the controlled pressure receiver 602 to the evaporator 604 (the heat exchanger 605 can be referred to as an evaporator 604 during a refrigeration cycle and as a condenser 604' during hot gas defrost) via the pressurized reservoir system 660. The pressurized reservoir system 660 can be provided as a single reservoir or as multiple reservoirs. In FIG. 7, multiple reservoirs are shown as first reservoir 661 and second reservoir 662. Liquid refrigerant can flow from the CPR 602 via the liquid refrigerant line 663 and the first valve 680 into the first reservoir 661. Once the first reservoir 661 is sufficiently full, hot gas via hot gas line 606 and valve 666 pressurizes the first reservoir 661 so that refrigerant flows into the evaporator 604. An optional solenoid 670 is shown, and would be opened when solenoid 666 is open for transferring liquid. While refrigerant flows from the first reservoir 661 into the evaporator 604, refrigerant from the CPR 602 flows via line 663 and valve 681 into the second reservoir 662. Once the second reservoir 662 is sufficiently full, the second reservoir 662 is pressurized by the hot gas via hot gas line 606, 708, and 709, and valve 667 to push refrigerant out of the second reservoir 662 and into the evaporator 604. An optional solenoid 671 is shown, and would be opened when solenoid 667 is open for transferring liquid. The two reservoirs 661 and 662 can alternate between filling and feeding the evaporator 604. More than two reservoirs can be utilized, if desired.

The line 672 may feature a metering device to regulate flow, if desired. The valve 682 and 683 can be used to equalize the pressure between the first and second reservoirs 661 and 662, thus allowing for the liquid to gravity drain from the first controlled pressure receiver 602 to the first and second reservoirs 661 and 662. Valves 680 and 681 can control the flow of refrigerant from the controlled pressure receiver 602 to the first and second reservoirs 661 and 662. Some piping may be eliminated by using combination valves such as three way valves.

Returning refrigerant is piped back to the first controlled pressure receiver 602 via line 690 through valve 692 where the gas and liquid are separated. The gas is drawn through line 620 and valve 622 and goes back to the engine room where is can be compressed.

During hot gas defrost, hot gas can be introduced to the heat exchanger 605 via line 708 and valve 710. Returning hot gas and liquid can be returned via line 720 and solenoid valve 721 (which may contain a float). Valves 730 and 732 are available to transfer this return to either the first controlled pressure receiver 602 or to the heat exchanger 601, which will be used as an evaporator to boil the liquid back into a gas to be returned to the engine room via line 632, and valve 634. There are piping variations depending on the preference of the design engineer, however the basic premise remains as described.

The above specification provides a complete description of the manufacture and use of the invention. Since many embodiments of the invention can be made without departing from the spirit and scope of the invention, the invention resides in the claims hereinafter appended.

We claim:

1. A condenser evaporator system containing gaseous ammonia refrigerant and liquid ammonia refrigerant, the system comprising:

(a) a condenser constructed for condensing the gaseous ammonia refrigerant provided at a condensing pressure to the liquid ammonia refrigerant;

(b) a gaseous refrigerant feed line for feeding the gaseous ammonia refrigerant to the condenser;

(c) a controlled pressure receiver for holding the liquid ammonia refrigerant;

(d) a first liquid refrigerant feed line for conveying the liquid ammonia refrigerant from the condenser to the controlled pressure receiver;

(e) an evaporator for evaporating the liquid ammonia refrigerant;

(f) a second liquid refrigerant feed line for conveying the liquid ammonia refrigerant from the controlled pressure receiver to the evaporator, wherein the condenser evaporator system is constructed so that the condenser and the evaporator are balanced during a refrigeration cycle; and (g) wherein the condenser evaporator system is constructed to operate in a refrigeration cycle and in a defrost cycle, and the condenser evaporator system is constructed to operate in the defrost cycle wherein the gaseous ammonia refrigerant provided at a condensing pressure is fed to the evaporator or wherein the condenser evaporator system is constructed to operate in the defrost cycle wherein the liquid ammonia refrigerant from the evaporator is fed to the condenser for evaporation.

2. A condenser evaporator system according to claim 1, wherein the condenser comprises a plate and frame heat exchanger.

3. A condenser evaporator system according to claim 1, further comprising:

(a) a gaseous refrigerant suction line for conveying the gaseous ammonia refrigerant from the evaporator.

4. A condenser evaporator system according to claim 1, further comprising:

(a) a second gaseous refrigerant line for conveying the gaseous ammonia refrigerant to the evaporator during the defrost cycle.

5. A condenser evaporator system according to claim 1, further comprising:

(a) a second gaseous refrigerant suction line for conveying the gaseous ammonia refrigerant from the condenser during the defrost cycle.

6. A condenser evaporator system according to claim 1, further comprising:

(a) a third liquid refrigerant line for conveying the liquid ammonia refrigerant from the evaporator to the controlled pressure receiver during the defrost cycle.

7. A condenser evaporator system according to claim 1, further comprising:

(a) a fourth liquid refrigerant line for conveying the liquid ammonia refrigerant from the controlled pressure receiver to the condenser during the defrost cycle.

8. A method of operating a condenser evaporator system, the method comprising:

(a) operating the condenser evaporator system in a refrigeration cycle comprising:

(i) feeding gaseous ammonia refrigerant at a condensing pressure to a condenser and condensing the gaseous ammonia refrigerant to liquid ammonia refrigerant;

(ii) storing the liquid ammonia refrigerant in a controlled pressure receiver;

(iii) evaporating the liquid ammonia refrigerant from the controlled pressure receiver in an evaporator;

(b) operating the condenser evaporator system in a defrost cycle comprising;

(i) feeding gaseous ammonia refrigerant at a condensing pressure to the evaporator and condensing the gaseous ammonia refrigerant to a liquid ammonia refrigerant;

(ii) storing the liquid ammonia refrigerant in the controlled pressure receiver; and (iii) evaporating the liquid ammonia refrigerant from the controlled pressure receiver in a condenser;

(c) wherein the operation of the condenser evaporator system in a refrigeration cycle and the operation of the condenser evaporator system in a defrost cycle do not occur at the same time.

9. A method according to claim 8, wherein the condenser comprises a plate and frame heat exchanger.

10. Multiple condenser evaporator systems arranged in a refrigeration system comprising:

a common gaseous ammonia refrigerant feed line from a compressor arrangement and constructed to feed gaseous ammonia refrigerant provided at a condensing pressure to the multiple condenser evaporator systems, wherein the multiple condenser evaporator systems comprise:

(a) a condenser constructed for condensing the gaseous ammonia refrigerant provided at a condensing pressure to liquid ammonia refrigerant;

(b) a gaseous refrigerant feed line for feeding the gaseous ammonia refrigerant from the common gaseous refrigerant feed line to the condenser;

(c) a controlled pressure receiver for holding the liquid ammonia refrigerant;

(d) a first liquid refrigerant feed line for conveying the liquid ammonia refrigerant from the condenser to the controlled pressure receiver;

(e) an evaporator for evaporating the liquid ammonia refrigerant; and (f) a second liquid refrigerant feed line for conveying the liquid ammonia refrigerant from the controlled pressure receiver to the evaporator.

11. Multiple condenser evaporator systems arranged in a refrigeration system according to claim 10, wherein the multiple condenser evaporator systems are constructed to operate in a refrigeration cycle and in a defrost cycle.

12. Multiple condenser evaporator systems arranged in a refrigeration system according to claim 10, wherein the multiple condenser evaporator systems are constructed to operate in a defrost cycle wherein the gaseous ammonia refrigerant provided at a condensing pressure is fed to the evaporator.

13. Multiple condenser evaporator systems arranged in a refrigeration system according to claim 10, wherein the multiple condenser evaporator systems are constructed to operate in a defrost cycle wherein the liquid ammonia refrigerant from the evaporator is fed to the condenser for evaporation.

14. Multiple condenser evaporator systems arranged in a refrigeration system according to claim 10, wherein the multiple condenser evaporator systems further comprise:

(a) a gaseous refrigerant suction line for conveying the gaseous ammonia refrigerant from the evaporator.

15. Multiple condenser evaporator systems arranged in a refrigeration system according to claim 10, wherein the multiple condenser evaporator systems further comprise:

(a) a second gaseous refrigerant line for conveying the gaseous ammonia refrigerant to the evaporator during a defrost cycle.

16. Multiple condenser evaporator systems arranged in a refrigeration system according to claim 10, wherein the multiple condenser evaporator systems further comprise:

(a) a second gaseous refrigerant suction line for conveying the gaseous ammonia refrigerant from the condenser during a defrost cycle.

17. Multiple condenser evaporator systems arranged in a refrigeration system according to claim 10, wherein the multiple condenser evaporator systems further comprise:

(a) a third liquid refrigerant line for conveying the liquid ammonia refrigerant from the evaporator to the controlled pressure receiver during a defrost cycle.

18. Multiple condenser evaporator systems arranged in a refrigeration system according to claim 10, wherein the multiple condenser evaporator systems further comprise:

(a) a fourth liquid refrigerant line for conveying the liquid ammonia refrigerant from the controlled pressure receiver to the condenser during a defrost cycle.

* * * * *